United States Patent [19]

Spargo, Sr.

[11] Patent Number: 4,980,942

[45] Date of Patent: Jan. 1, 1991

[54] SHREDDER/CURLING DEVICE

[75] Inventor: Robert M. Spargo, Sr., Gastonia, N.C.

[73] Assignee: Ad-Teck Limited, Clover, S.C.

[21] Appl. No.: 482,564

[22] Filed: Feb. 21, 1990

[51] Int. Cl.[5] ..... B25F 1/00

[52] U.S. Cl. ..... 7/158; 30/304; 30/295

[58] Field of Search ..... 7/158, 170; 30/304, 30/299, 279.2, 280, 286, 287, 295, 123

[56] References Cited

U.S. PATENT DOCUMENTS 3,883,953 5/1975 Saullo et al. ..... 30/304

FOREIGN PATENT DOCUMENTS 117862 5/1987 Japan ..... 7/158

*Primary Examiner*—Roscoe V. Parker

*Attorney, Agent, or Firm*—Dority & Manning

[57] ABSTRACT

A device for curling and shredding ribbon includes a handle having a recess for receiving the end of a thumb of a person grasping the device. A support member extends from the handle and supports a plurality of flat, planar blade members extending perpendicularly from the surface of the support member. A diagonal surface forms a sharp edge on one side of the support member, and a second diagonal surface forms a sharp edge on the opposite side of the support member. A plurality of blades are disposed side-by-side spaced apart and parallel to one another along the length of the support member. Each blade is oriented to extend in a direction transverse to the longitudinal axis of the sharp edges formed by the diagonal surfaces. Each blade has a cutting edge formed around the free edges thereof and formed by opposed convex surfaces having the same radius of curvature. A shield is provided between the handle and the support member carrying the blades.

13 Claims, 2 Drawing Sheets

SHREDDER/CURLING DEVICE

BACKGROUND OF THE INVENTION

The present invention relates to devices used in wrapping packages and more particularly to ribbon shredding devices and ribbon curling devices.

Everyone has used ribbon formed of polypropylene or other materials to wrap a gift at one time or another. Department stores and smaller gift shops use ribbon in their gift wrapping services.

One manner of curling a ribbon involves holding it against one of the cutting edges of a scissor and pulling it over this edge to abrade the flat surface of the ribbon.

One device used to shred ribbon relies upon two flat plastic members disposed one above the other to form a sandwich. The bottom member has four vertical posts extending therefrom in a perpendicular direction from its flat surface. A biasing spring is placed over each post, which extends through one of four holes formed through the top member. Accordingly, the springs bias the upper member away from contact with the lower member. The end of each post is formed into a cap that is larger than the holes in the top member and forms a stop to prevent the springs from pushing the top member off the posts. On the underside surface of the top member, a plurality of pins project therefrom in a direction normal to this surface. The free ends of the pins are sharpened into points. The pins are arranged next to one another in a straight line extending for a majority of the length of the upper member. Immediately beneath the pins, a slot is formed beneath the surface of the bottom member. The top member is pressed toward the bottom member against the biasing of the springs until the points of the pins rest against the bottom of the slot formed in the bottom member. In operation, a ribbon is placed beneath the pins and above the slot. The top member is pressed down toward the bottom member so that the pins penetrate through the ribbon. As the end of the ribbon is pulled through the space between the upper and lower members, the pins shred the ribbon being pulled through the device.

Once the ribbon is shredded using the above device, it is difficult to curl it without the shredded portions becoming entangled or breaking. Similarly, once a ribbon is curled, such as in the manner using a scissor as described above, it is difficult for the shredder described above to shred the curled ribbon. Moreover, the curling and shredding of the ribbon requires two operations and two separate mechanisms.

OBJECTS AND SUMMARY OF THE INVENTION

It is a principal object of the present invention to provide a device which both shreds and curls ribbon in a single pass of the ribbon through the device.

Another principal object of the present invention is to provide a device that can be used selectively for either shredding a ribbon or curling a ribbon.

A further principal object of the present invention is to provide a device for shredding and curling ribbon that can be safely operated by individuals without extensive training or manual dexterity.

Still another principal object of the present invention is to provide a device for curling and shredding ribbon wherein the device has low manufacturing costs, low maintenance costs and no moving parts.

Yet another principal object of the present invention is to provide a ribbon curling and shredding device that can be safely operated by the average individual consumer, whether such consumer is right-handed or left-handed.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the device for shredding and curling a length of flat ribbon includes a handle, an elongated support member attached to the handle and defining at least one elongated sharp edge for curling ribbon, and a plurality of means for separating the ribbon into discrete segments.

The handle preferably is elongated and defines a flat, planar surface as a top face. In an alternative embodiment, a recess is formed in the handle beneath the surface of the top face. The recess is configured to receive and accommodate the underside of a human thumb to facilitate a comfortable secure grasp of the handle by an individual holding the device.

The elongated support member defines a blade carriage portion having a flat, planar surface as a top face. Another flat planar surface preferably defines the bottom face of the blade carriage portion and is disposed opposite and parallel to the top face of the blade carriage portion. The top face of the handle and the top face of the blade carriage portion also preferably are disposed parallel to one another. A diagonal ramp can be provided to connect the top face of the handle with the top face of the blade carriage portion. Alternatively, a smoothly curving ramp can perform this connecting function.

The separating means is used to shred the ribbon by separating the ribbon into discrete segments. The separating means preferably is secured to and extends away from the support member. As embodied herein, each separating means preferably defines a blade member secured to and extending upwardly from the top face of the blade carriage portion. Each blade member preferably is generally planar and rectangular in shape and extends perpendicularly from the top face of the blade carriage portion. Preferably, a plurality of blade members are disposed side-by-side in a row along the length of the top face of the blade carriage portion. Each blade member is spaced apart from and disposed parallel to each adjacent blade member and has a breadth dimension extending in the direction of the narrow dimension of the device of the present invention and perpendicular to the longitudinal axis of the handle and the blade carriage portion.

Each blade member defines an arcuate cutting edge, and the center of the arc defining the cutting edge preferably is disposed as the symmetric center of the blade. The cutting edge preferably is formed by opposed tapered convex arcuate surfaces having the same radius of curvature. Not only does the cutting edge extend along the upper free edge of each blade, but also extends down the free edges on both sides of each blade.

A diagonal surface preferably extends from the top face of the blade carriage portion to the longitudinal free edge along the bottom face of the blade carriage portion and forms a sharp edge at the longitudinal free edge along the bottom face of the blade carriage portion. This sharp edge is provided for purposes of curling the ribbon. Preferably, a second elongated sharp edge for curling the ribbon is formed by a second diagonal surface on the opposite side of the blade carriage portion.

In further accordance with an alternative embodiment of the present invention, a shield is disposed between the handle and the support member carrying the separating means. The shield preferably extends perpendicularly from the top face of the handle and provides a convenient place against which the holder of the handle may rest the thumb when grasping the handle.

All of the various structures forming the device of the present invention preferably are formed as a unitary molded plastic structure. The plastic used to form the device must have sufficient hardness to enable formation of the sharp edge sufficient to curl the ribbon and cutting edges for the blades sufficiently sharp to cut through and shred the ribbon. A polycarbonate material can be used to form the device.

The accompanying drawings, which are incorporated in and constitute a part of this specification, illustrate one embodiment of the invention and, together with the description, serve to explain the principles of the invention.

DETAILED DESCRIPTION OF THE PREFERRED EMBODIMENTS

Reference now will be made in detail to the present preferred embodiments of the present invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover the modifications and variations of this invention provided they come within the scope of the appended claims and their equivalents.

Figure 1:
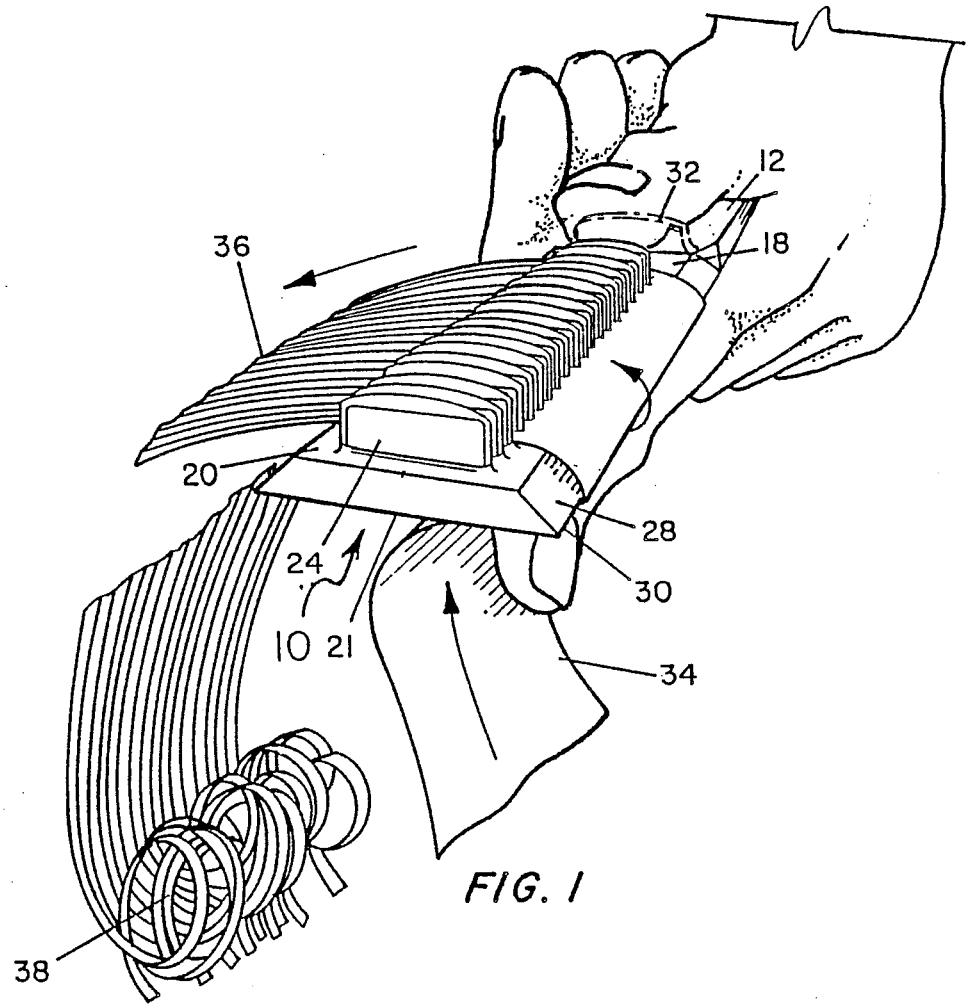
FIG. 1 illustrates an elevated plan perspective view of a preferred embodiment of the present invention with a ribbon shown during operation of the device.
Figure 2:
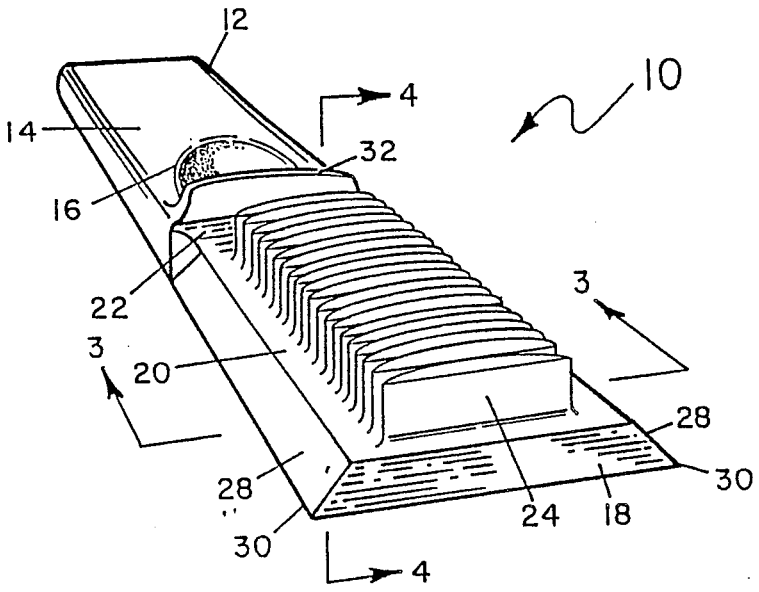
FIG. 2 is an elevated perspective side view of the device shown in FIG. 1.

A preferred embodiment of the shredder/curler device of the present invention is shown in FIGS. 1 and 2 and is represented generally by the numeral 10.

In accordance with the present invention, a device is provided for reconfiguring a flat length of ribbon such as a polypropylene ribbon of from 3/16 of an inch to 3 inches wide and any of various lengths, as desired by the user. The device of the present invention includes a handle portion. As embodied herein and shown in FIGS. 1 and 2 for example, a handle 12 defines an elongated member, preferably formed of molded plastic and having a generally rectangular shape. As shown in FIG. 2 for example, handle 12 further defines a generally flat, planar surface to form a top face 14. Handle 12 further defines a bottom face 15 which preferably is a generally flat, planar surface disposed parallel and opposite to top face 14.

In an alternative embodiment of the present invention, a recess 16 is formed in handle 12 beneath the surface of top face 14 and in a configuration which accommodates the underside of a human thumb as shown in FIG. 1 for example. Recess 16 is shown in dashed lines in FIGS. 2 and 4. Recess 16 accommodates the thumb of the person grasping handle 12 and ensures both comfort and a secure grasp of handle 12.

In further accordance with the present invention, an elongated support member is attached to the handle. As embodied herein and shown in FIGS. 1–4 for example, an elongated support member defines a blade carriage portion 18 disposed adjacent to and integrally formed with handle portion 14. Blade carriage portion 18 preferably defines a top face 20 which forms a generally flat, planar surface. Blade carriage portion 18 further preferably defines a bottom face 21 forming a generally flat, planar surface disposed opposite top face 20 and parallel to top face 20. Preferably, top and bottom faces 14, 15 of handle 14 are disposed parallel to top and bottom faces 20, 21 of blade carriage portion 18.

Figure 4:
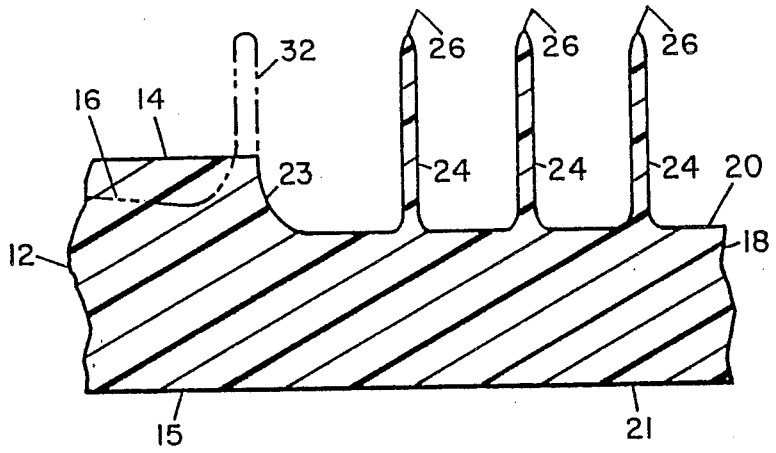
FIG. 4 is a partial cross-sectional view taken along the line of sight indicated by the arrows designated 4—4 in FIG. 2.

As shown in FIG. 2 for example, a diagonal ramp 22 connects top face 14 of handle 12 with top face 20 of blade carriage portion 18. As shown in FIG. 4 for example, a smoothly curving ramp 23 provides an alternative design for connecting top faces 14, 20.

Figure 3:
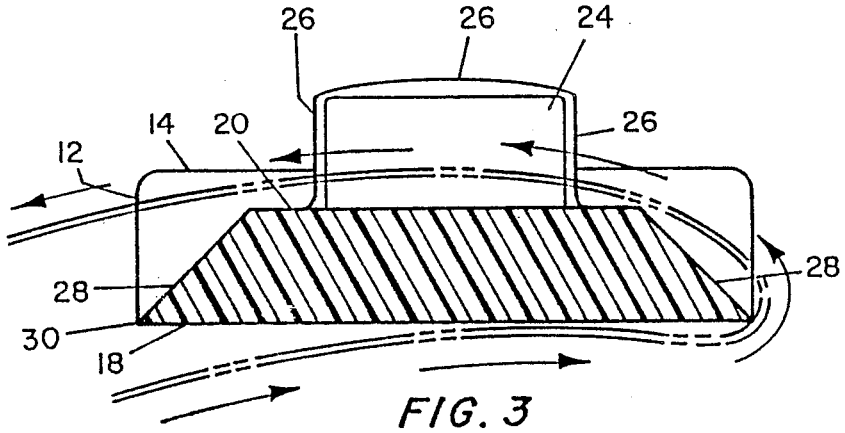
FIG. 3 is a cross-sectional view of the device shown in FIGS. 1 and 2 taken along the line of sight indicated by the arrows designated 3—3 in FIG. 2.

In still further accordance with the present invention, a plurality of means are provided for separating a ribbon into discrete segments. As embodied herein and shown in FIGS. 1–4 for example, the means for separating a ribbon into discrete segments preferably includes a blade member 24 secured to and extending upwardly from top face 20 of blade carriage portion 18. Each blade member 24 preferably is generally planar and rectangular in shape and extends in a normal, i.e., perpendicular, direction from top face 20 of blade carriage portion 18. Preferably, a plurality of blade members 24 are disposed along the length of top face 20 of blade carriage portion 18. As shown in FIGS. 1, 2 and 4 for example, the plurality of blades 24 preferably are arranged side-by-side in a row down the length of blade carriage portion 18. Thus, blade carriage portion 18 provides a support member for the plurality of separating means of the present invention. Preferably, the plurality of planar blade members are disposed spaced apart from one another and parallel to each other along the length of blade carriage portion 18. As shown in FIGS. 1–3 for example, each blade 24 defines a breadth dimension extending in the direction of the narrow dimension of the device of the present invention. Thus, the breadth dimension extends in a direction perpendicular to the longitudinal axis of handle 12 and blade carriage portion 18 connected to handle 12.

As shown in FIGS. 3 and 4 for example, each blade 24 defines an arcuate cutting edge 26. The center of the arc defining cutting edge 26 preferably is disposed at the symmetric center of blade 24, as shown in FIG. 3 for example. As shown in FIG. 4 for example, cutting edge 26 preferably is formed by opposed tapered convex arcuate surfaces having the same radius of curvature. As shown in FIGS. 1 and 3 for example, arcuate cutting edge 26 extends not only on the upper free edge of each blade 24 disposed opposite blade carriage portion 18, but also down the free edges on both sides of blade 24.

In further accordance with the present invention, a diagonal surface is provided to form an elongated sharp edge for curling ribbon. As embodied herein and shown in FIGS. 1–3 for example, a diagonal surface 28 extends from top face 20 of blade carriage portion 18 to the longitudinal free edge 30 of bottom face 21 of blade carriage portion 18. Diagonal surface 28 and bottom face 21 of blade carriage portion 18 join to form a sharp edge at longitudinal free edge 30 of bottom face 21 of blade carriage portion 18. As shown in FIGS. 2 and 3 for example, a second elongated sharp edge for curling ribbon is formed by a second diagonal surface 28 on the opposite side of blade carriage portion 18.

The symmetry of blades 24 with their arcuate cutting edges 26 around each free edge of same combines with the symmetry of opposed diagonal surfaces 28 joining to form opposite sharp edges at opposite longitudinal free edges 30 of bottom face 21 of blade carriage portion 18. This dual symmetry enables the device of the present invention to be held by left-handed or right-handed persons and to shred and curl ribbon by moving the ribbon in the direction of the arrows shown in FIG. 1 or by reversing the movement of the ribbon to that shown in FIG. 1.

In yet further accordance with the present invention, a shield can be disposed between the handle and the support member carrying the plurality of separating means. As embodied herein and shown in dashed lines in FIGS. 1, 2, and 4 for example, a shield 32 is disposed between handle 12 and blade carriage portion 18. Shield 32 provides a convenient place against which the holder may rest the thumb when grasping handle 12. Shield 32 also safeguards against the tip of the thumb accidentally sliding across one of cutting edges 26 or being cut by the free edge of the ribbon being pulled through blades 24.

Examples of the dimensions for a preferred embodiment of the present will now be described. Preferably a unitary structure formed of molded plastic defines handle 12, blade carriage portion 18, recess 16, blade members 24, diagonal surfaces 28, and shield 32. The combined length of handle 12 and blade carriage portion 18 preferably is about 5 inches. The width of each of handle 12 and blade carriage portion 18 preferably is about 1 inch. The depth of the handle portion is preferably about one quarter inch measured in a direction perpendicular to the bottom face and the top face. The maximum depth of the blade carriage portion of the device is preferably about 0.180 inches measured in a direction perpendicular to the bottom face of the blade carriage portion. The width of the top face of the blade carriage portion is preferably about one half inch. The length of the top face of the blade carriage portion is preferably about $2\frac{7}{8}$ inches. Diagonal ramp 22 connecting top face 14 of handle portion 12 to top face 20 of blade carriage portion 18 preferably rises over a linear distance of about $\frac{1}{8}$ inch in a direction parallel to the top face of the handle and the top face of the blade carriage.

Each generally rectangular blade 24 preferably has a breadth of one quarter inch, a maximum height of 0.187 inch above the top face of the blade carriage portion, and a thickness of 0.035 inch. The 0.187 inch maximum height of each blade is measured at the center of the arc, which is also the symmetric center of the blade. Preferably, twenty identical blades are arranged side-by-side in a row, and adjacent blades are preferably separated by 0.100 inch. The blade arranged nearest the free edge of the blade carriage portion is preferably separated therefrom by 0.150 inch. Each diagonal surface 28 preferably extends from the top face of the blade carriage portion to one of the longitudinal free edges of the bottom face of the blade carriage portion over a linear distance of about 0.180 inch measured in a direction parallel to the width of the blade carriage portion. Thus, each diagonal surface 28 forms a 45 degree angle between itself and each of the top and bottom faces of the blade carriage portion.

In operation, the device of the present invention can be held in either the left hand or the right hand of the operator. As shown in FIG. 1 for example, handle 12 is grasped with the left thumb resting in recess 16 and with the tip resting against shield 32 while the index finger is positioned beneath blade carriage portion 18 opposite bottom face 21 of blade carriage portion 18. A length of flat ribbon 34 is threaded between the index finger and bottom face 21 of blade carriage portion 18 and wound around and over diagonal surface 28 on one side of blade carriage portion 18. The ribbon is pressed down on top of cutting edges 26 of blade members 24, which penetrate through ribbon 34, and then pulled with a continuous motion against top face 20 of blade carriage portion 18 in the direction shown by the arrows in FIG. 1. As ribbon 34 moves over the sharp edge formed by diagonal surface 28 and bottom face 21 at longitudinal free edge 30 shown in FIG. 1 for example, the ribbon is curled. As the curled ribbon is pulled through blade members 24, cutting edges 26 slice through ribbon 34 and shred same. The separated segments of ribbon 34 are shown at 36 in FIG. 1 for example. Upon releasing tension on the ribbon being pulled through blade members 24, the separated segments of ribbon 34 curl as shown at 38 of FIG. 1 for example. Alternatively, the same process can be performed by holding handle 12 in the right hand while pulling the ribbon with the left hand in the opposite direction from that shown in FIG. 1. Moreover, the device of the present invention can be manipulated so as only to curl the ribbon by passing it across one of the sharp edges formed at longitudinal free edge 30. In addition, the device of the present invention can be operated so as only to shred the ribbon by placing the index finger on top of the ribbon against diagonal surface 28 while pulling the ribbon through blades 24.

What is claimed is:

1. A device for reconfiguring a flat length of ribbon, comprising:

(a) a handle;

(b) an elongated support member attached to said handle;

(c) a plurality of means for separating the ribbon into discrete segments, said separating means being secured to and extending away from said support member; and (d) said support member defining at least one elongated sharp edge for curling ribbon.

2. A device as in claim 1, wherein:

said sharp edge being configured and disposed so that a motion used to separate the ribbon with said separating means can be the same motion used to pull the ribbon across said sharp edge.

3. A device for reconfiguring a flat length of ribbon, comprising:

(a) a handle;

(b) an elongated support member attached to said handle;

(c) a plurality of means for separating the ribbon into discrete segments, said separating means being secured to and extending away from said support member; and (d) said support member defining at least one elongated sharp edge for curling ribbon; and said sharp edge being defined at least in part by a surface biased at an acute angle beneath the plane in which said support member is disposed, said biased surface extending along the length of said support member to at least one side of said separating means.

4. A device as in claim 1, wherein:

a unitary structure defines said handle, said support member, said separating means, and said sharp edge.

5. A device as in claim 1, further comprising:

a shield disposed between said handle and said support member.

6. A device as in claim 1, further comprising:

a recess defined in said handle near said support member, said recess being configured to received the end of a human thumb.

7. A device as in claim 1, further comprising:

a second elongated sharp edge for curling ribbon, said support member defining said second elongated sharp edge for curling ribbon, said second elongated sharp edge for curling ribbon being disposed opposite said at least one elongated sharp edge for curling ribbon.

8. A device for curling and shredding ribbon, comprising:

(a) a handle;

(b) an elongated support member attached to said handle;

(c) a plurality of planar blade members extending from said support member in a direction parallel to each other; and (d) said support member defining at least one elongated sharp edge for curling ribbon.

9. A device as in claim 8, wherein:

at least one of said planar blade members defines an arcuate cutting edge disposed on the free end of said blade member opposite the end secured to said support member.

10. A device as in claim 9, wherein:

each said cutting edge defines a pair of opposed arcuate surfaces.

11. A device as in claim 8, wherein:

at least one of said planar blade members defines an arcuate cutting edge disposed on each of the free ends of said blade member.

12. A device for reconfiguring a flat length of ribbon, the device comprising:

(a) a handle portion defining an elongated member formed of molded plastic and having a generally rectangular shape, said handle portion further defining a top face and a bottom face disposed opposite to and parallel to said top face, each of said top face and said bottom face defining a generally flat, planar surface;

(b) a blade carriage portion disposed adjacent to and integrally formed with said handle portion, said blade carriage portion defining a top face forming a generally flat, planar surface, said blade carriage portion further defining a bottom face forming a generally flat, planar surface disposed opposite said blade carriage top face;

(c) said top and bottom faces of said handle portion and said top and bottom faces of said blade carriage portion being disposed parallel to each other;

(d) a plurality of blades disposed along the length of said top face of said blade carriage portion, each said blade extending normally from said top face of said blade carriage portion, each blade defining a generally rectangular shape, each blade having a breadth extending in a direction perpendicular to the longitudinal axis of said member, said blades being spaced apart and arranged side-by-side in a row, each blade defining an arcuate cutting edge, wherein the center of the arc defining said cutting edge is also the symmetric center of said blade, said cutting edge being formed by tapered opposite surfaces of the free edge of said blade, said tapered surfaces having the same radius of curvature;

(e) a diagonal surface extending from said top face of said blade carriage portion to the longitudinal free edge of said bottom face of said blade carriage portion, wherein said diagonal surface and said bottom face of said blade carriage portion join to form a sharp edge at said longitudinal free edge of said bottom face of said blade carriage portion; and (f) a shield disposed between said handle and said support member.

13. A device as in claim 12, further comprising:

a diagonal ramp connecting said top face of said handle portion to said top face of said blade carriage portion.

* * * * *

US004980942B1

REEXAMINATION CERTIFICATE (2106th)

United States Patent [19]

[11] B1 4,980,942

Spargo, Sr.

[45] Certificate Issued Oct. 12, 1993

[54] SHREDDER/CURLING DEVICE

[75] Inventor: Robert M. Spargo, Sr., Gastonia, N.C.

[73] Assignee: Ad-Teck Limited, Clover, N.C.

Reexamination Request:
No. 90/002,759, Jun. 22, 1992

Reexamination Certificate for:

| | |
|---|---|
| Patent No.: | 4,980,942 |
| Issued: | Jan. 1, 1991 |
| Appl. No.: | 482,564 |
| Filed: | Feb. 21, 1990 |

[51] Int. Cl.[5] ..... B25F 1/00
[52] U.S. Cl. ..... 7/158; 30/296; 30/304
[58] Field of Search ..... 7/158, 170; 30/304, 30/299, 279.2, 280, 286, 287, 295, 123, 345

[56] References Cited

U.S. PATENT DOCUMENTS

D. 247,142 2/1978 Parent .
1,754,543 9/1925 Callum .
5,072,515 12/1991 Heitz .

*Primary Examiner*—Roscoe V. Parker, Jr.

[57] ABSTRACT

A device for curling and shedding ribbon includes a handle having a recess for receiving the end of a thumb of a person grasping the device. A support member extends from the handle and supports a plurality of flat, planar blade members extending perpendicularly from the surface of the support member. A diagonal surface forms a sharp edge on one side of the support member, and a second diagonal surface forms a sharp edge on the opposite side of the support member. A plurality of blades are disposed side-by-side spaced apart and parallel to one another along the length of the support member. Each blade is oriented to extend in a direction transverse to the longitudinal axis of the sharp edges formed by the diagonal surfaces. Each blade has a cutting edge formed around the free edges thereof and formed by opposed convex surfaces having the same radius of curvature. A shield is provided between the handle and the support member carrying the blades.

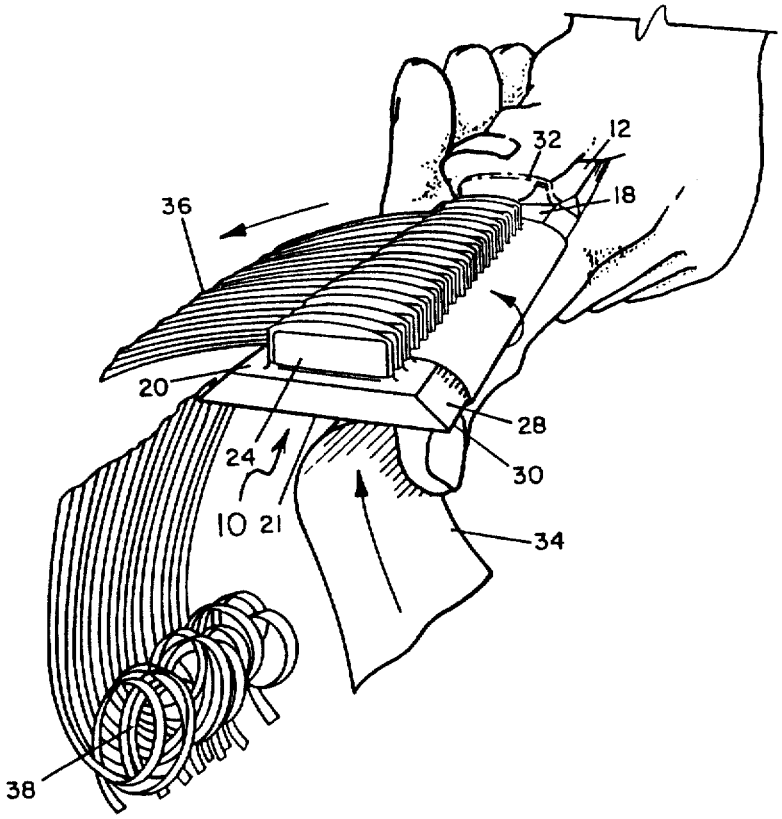

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 12 and 13 is confirmed.

Claim 6 is cancelled.

Claims 1, 3, 8 and 9 are determined to be patentable as amended.

Claims 2, 4, 5, 7, 10 and 11, dependent on an amended claim, are determined to be patentable.

1. A device for reconfiguring a flat length of ribbon, comprising:

(a) a handle;

(b) an elongated support member attached to said handle;

(c) a plurality of means for separating the ribbon into discrete segments, said separating means being secured to and extending away from said support member; [and]

(d) said support member defining at least one elongated sharp edge for curling ribbon*; and*

*a recess defined in said handle near said support member, said recess being configured to receive the end of a human thumb.*

3. A device for reconfiguring a flat length of ribbon, comprising:

(a) a handle;

(b) an elongated support member attached to said handle;

(c) a plurality of means for separating the ribbon into discrete segments, said separating means being secured to and extending away from said support member; and (d) said support member defining at least one elongated sharp edge for curling ribbon; and said sharp edge being defined [at least in part by a surface biased at an acute angle] beneath the plane in which said support is disposed *at least in part by a surface biased at an acute angle*, said biased surface extending along the length of said support member to at least one side of said separating means.

8. A device for curling and shredding ribbon, comprising:

(a) a handle *having an upper surface extending along a first plane;*

(b) an elongated support member attached to said handle *having an upper surface extending along a second plane;*

(c) a plurality of planar blade members extending from said support member in a direction parallel to each other; and (d) said support member defining at least one elongated sharp edge for curling ribbon *said sharp edge extending along a third plane which is parallel with and below at least one of said first and second planes.*

9. A device [as in claim 8, wherein:] *for curling and shredding ribbon comprising:*

*(a) a handle;*

*(b) an elongated support member attached to said handle;*

*(c) a plurality of planar blade members extending from said support member in a direction parallel to each other;*

*(d) said support member defining at least one elongated sharp edge for curling ribbon; and* at least one of said planar blade members defines an arcuate cutting edge disposed [on] *over* the free end of said blade member opposite the end secured to said support member.

* * * * *